US011751675B2

(12) United States Patent
Wong et al.

(10) Patent No.: US 11,751,675 B2
(45) **Date of Patent: *Sep. 12, 2023**

(54) TOOTHBRUSH

(71) Applicant: Colgate-Palmolive Company, New York, NY (US)

(72) Inventors: Chi Shing Wong, Warren, NJ (US); Douglas J. Hohlbein, Hopewell, NJ (US); Kenneth Waguespack, North Brunswick, NJ (US); Al Sprosta, Maplewood, NJ (US); Wen Jin Xi, Shanghai (CN); Xiangji Ding, YangZhou (CN)

(73) Assignee: Colgate-Palmolive Company, New York, NY (US)

( * ) Notice: Subject to any disclaimer, the term of this patent is extended or adjusted under 35 U.S.C. 154(b) by 143 days.

This patent is subject to a terminal disclaimer.

(21) Appl. No.: 17/249,055

(22) Filed: Feb. 18, 2021

(65) Prior Publication Data

US 2021/0169207 A1 Jun. 10, 2021

Related U.S. Application Data

(63) Continuation of application No. 16/048,747, filed on Jul. 30, 2018, now Pat. No. 10,952,526, which is a (Continued)

(51) Int. Cl.

| | |
|---|---|
| ***A46B 5/02*** | (2006.01) |
| ***A46B 9/04*** | (2006.01) |
| ***A46B 15/00*** | (2006.01) |

(52) U.S. Cl.

CPC ..... *A46B 5/026* (2013.01); *A46B 5/02* (2013.01); *A46B 9/04* (2013.01); *A46B 15/0016* (2013.01);

(Continued)

(58) Field of Classification Search

CPC .. A46B 5/02; A46B 5/026; A46B 9/04; A46B 15/0087

See application file for complete search history.

(56) References Cited

U.S. PATENT DOCUMENTS

| | | | |
|---|---|---|---|
| 3,120,670 | A | 2/1964 | Amodeo |
| 4,150,457 | A | 4/1979 | Larson |

(Continued)

FOREIGN PATENT DOCUMENTS

| | | |
|---|---|---|
| CA | 2238099 | 4/1999 |
| CN | 2376791 | 5/2000 |

(Continued)

OTHER PUBLICATIONS

International Search Report issued in International Application PCT/US2008/068000 dated Sep. 10, 2009.

*Primary Examiner* — Randall E Chin

(57) ABSTRACT

An toothbrush having a handle and a head. The handle may include a first component and a second component covering at least a portion of the first component. The first and second components may be chemically compatible. The first and second components may both comprise a hard polyolefin. The first and second components may have different transparencies. In one aspect, the first component may be opaque and the second component may be transparent or semi-transparent. In some aspects, the handle may also include a third component comprising a thermoplastic elastomer. Furthermore, there may be at least one projection extending outwardly from an outer surface of the first component.

8 Claims, 5 Drawing Sheets

Related U.S. Application Data continuation of application No. 14/639,848, filed on Mar. 5, 2015, now Pat. No. 10,070,715, which is a continuation of application No. 14/108,887, filed on Dec. 17, 2013, now Pat. No. 8,997,301, which is a continuation of application No. 13/461,083, filed on May 1, 2012, now Pat. No. 8,745,805, which is a continuation of application No. 12/142,900, filed on Jun. 20, 2008, now Pat. No. 8,510,893.

(52) U.S. Cl.
CPC ..... *A46B 15/0087* (2013.01); *A46B 15/0055* (2013.01); *A46B 2200/1066* (2013.01)

(56) References Cited

U.S. PATENT DOCUMENTS

| | | | |
|---|---|---|---|
| 4,283,808 | A | 8/1981 | Beebe |
| 4,449,934 | A | 5/1984 | Salam |
| 4,542,552 | A | 9/1985 | d'Argembeau |
| 4,665,921 | A | 5/1987 | Teranishi et al. |
| 4,944,296 | A | 7/1990 | Suyama |
| 5,217,475 | A | 6/1993 | Kuber |
| 5,369,835 | A | 12/1994 | Clarke |
| 5,398,369 | A | 3/1995 | Heinzelman et al. |
| 5,628,082 | A | 5/1997 | Moskovich |
| 5,709,005 | A | 1/1998 | Brach, Jr. et al. |
| 5,735,012 | A | 4/1998 | Heinzelman et al. |
| 5,755,020 | A | 5/1998 | Panyon, Jr. |
| 5,881,425 | A | 3/1999 | Hudson et al. |
| 5,998,431 | A | 12/1999 | Tseng et al. |
| D427,437 | S | 7/2000 | Vonarburg |
| 6,108,869 | A | 8/2000 | Meessmann et al. |
| 6,178,583 | B1 | 1/2001 | Volpenhein |
| 6,199,242 | B1 | 3/2001 | Masterman et al. |
| 6,220,673 | B1 | 4/2001 | Russell et al. |
| 6,276,021 | B1 | 8/2001 | Hohlbein |
| 6,298,516 | B1 | 10/2001 | Beals et al. |
| 6,367,112 | B1 | 4/2002 | Moskovich et al. |
| D458,453 | S | 6/2002 | Baertschi |
| 6,496,998 | B2 | 12/2002 | Moran |
| 6,514,445 | B1 | 2/2003 | Cann et al. |
| 6,611,984 | B1 | 9/2003 | Halm |
| 6,687,940 | B1 | 2/2004 | Gross et al. |
| 6,779,216 | B2 | 8/2004 | Davies et al. |
| 6,850,167 | B2 | 2/2005 | Rosen |
| 6,859,969 | B2 | 3/2005 | Gavney, Jr. et al. |
| 6,919,038 | B2 | 7/2005 | Meyer et al. |
| 6,968,590 | B2 | 11/2005 | Ponzini |
| D514,812 | S | 2/2006 | Hohlbein et al. |
| D514,815 | S | 2/2006 | Moskovich et al. |
| D517,812 | S | 3/2006 | Hohlbein et al. |
| 7,039,984 | B1 | 5/2006 | Watanabe et al. |
| 7,047,591 | B2 | 5/2006 | Hohlbein |
| 7,049,790 | B2 | 5/2006 | Pfenniger et al. |
| D527,907 | S | 9/2006 | Kling et al. |
| D528,802 | S | 9/2006 | Moskovich et al. |
| D531,412 | S | 11/2006 | Wong |
| D531,414 | S | 11/2006 | Wong |
| D531,810 | S | 11/2006 | Moskovich |
| D532,607 | S | 11/2006 | Hohlbein |
| D533,351 | S | 12/2006 | Wong |
| D549,965 | S | 9/2007 | Wong |
| D557,503 | S | 12/2007 | Wong |
| D559,546 | S | 1/2008 | Wong |
| 7,383,619 | B2 | 6/2008 | Gross et al. |
| 7,415,788 | B2 | 8/2008 | Little |
| 7,458,125 | B2 | 12/2008 | Hohlbein et al. |
| 7,503,092 | B2 | 3/2009 | Russell |
| 7,600,285 | B2 | 10/2009 | Jimenez et al. |
| 7,614,111 | B2 | 11/2009 | Moskovich et al. |
| 7,827,704 | B2 | 11/2010 | Fox et al. |
| 7,836,539 | B2 | 11/2010 | Moskovich et al. |
| 7,937,794 | B2 | 5/2011 | Huber et al. |
| 8,015,982 | B2 | 9/2011 | Wilkinson |
| 8,060,972 | B2 | 11/2011 | Geiberger et al. |
| 8,281,448 | B2 | 10/2012 | Waguespack et al. |
| 9,539,750 | B2 | 1/2017 | Gross et al. |
| 2001/0002605 | A1 | 6/2001 | Morawski et al. |
| 2002/0138931 | A1 | 10/2002 | Davies |
| 2003/0005544 | A1 | 1/2003 | Felix |
| 2003/0070259 | A1 | 4/2003 | Brown et al. |
| 2004/0139569 | A1 | 7/2004 | Chen |
| 2005/0066459 | A1 | 3/2005 | Pinyayev et al. |
| 2005/0109364 | A1 | 5/2005 | Gross et al. |
| 2005/0260535 | A1 | 11/2005 | Costaras et al. |
| 2005/0260536 | A1 | 11/2005 | Costaras et al. |
| 2006/0021173 | A1* | 2/2006 | Huber ..... A46B 5/02 15/167.1 |
| 2006/0064833 | A1 | 3/2006 | Jacobs |
| 2006/0123574 | A1 | 6/2006 | Storkel et al. |
| 2006/0257197 | A1 | 11/2006 | Papa et al. |
| 2006/0269351 | A1 | 11/2006 | McAfee |
| 2007/0022552 | A1 | 2/2007 | Scheepers |
| 2007/0028941 | A1 | 2/2007 | Oronsky et al. |
| 2007/0105063 | A1 | 5/2007 | Pinyayev et al. |
| 2007/0163064 | A1 | 7/2007 | Wong et al. |
| 2007/0186453 | A1 | 8/2007 | Little et al. |
| 2007/0231052 | A1 | 10/2007 | Latour et al. |
| 2008/0086827 | A1* | 4/2008 | Waguespack ..... A46B 5/0029 15/105 |
| 2009/0072610 | A1 | 3/2009 | Sorrentino et al. |

FOREIGN PATENT DOCUMENTS

| | | |
|---|---|---|
| DE | 102006005616 | 8/2007 |
| EP | 0051949 | 5/1982 |
| EP | 0052353 | 5/1982 |
| EP | 0360766 | 3/1990 |
| EP | 1621106 | 2/2006 |
| GB | 469566 | 7/1937 |
| GB | 2339391 | 1/2000 |
| JP | 10276836 | 10/1998 |
| JP | 2002-018895 | 1/2002 |
| JP | 2004-290363 | 10/2004 |
| JP | 2006-000202 | 1/2006 |
| WO | 1996/038068 | 12/1996 |
| WO | 1999/047020 | 9/1999 |
| WO | 2001/043582 | 6/2001 |
| WO | 2003/001942 | 1/2003 |
| WO | 2004/026162 | 4/2004 |
| WO | 2005/084487 | 9/2005 |
| WO | 2006/015196 | 2/2006 |
| WO | 2006/043758 | 4/2006 |
| WO | 2006/109077 | 10/2006 |
| WO | 2007/003387 | 1/2007 |
| WO | 2007/106757 | 9/2007 |

* cited by examiner

TOOTHBRUSH

CROSS-REFERENCE TO RELATED APPLICATIONS

The present application is a continuation of U.S. patent application Ser. No. 16/048,747, filed Jul. 30, 2018, now U.S. Pat. No. 10,952,526, which is a continuation of U.S. patent application Ser. No. 14/639,848, filed Mar. 5, 2015, now U.S. Pat. No. 10,070,715, which is a continuation of U.S. patent application Ser. No. 14/108,887, filed Dec. 17, 2013, now U.S. Pat. No. 8,997,301, which is a continuation of U.S. patent application Ser. No. 13/461,083, filed May 1, 2012, now U.S. Pat. No. 8,745,805, which is a continuation of U.S. patent application Ser. No. 12/142,900, filed on Jun. 20, 2008, now U.S. Pat. No. 8,510,893, the entireties of which are hereby incorporated by reference.

BACKGROUND

The present invention relates to multi-component toothbrushes having enhanced visual and/or scenting effects resulting from the properties (e.g., transparency) and structural configuration (e.g., use of a base component having projections) of the toothbrush components.

Toothbrushes are often constructed from multiple components having dissimilar properties in terms of hardness, texture, color, etc. to provide an overall product possessing a number of desired features, such as ease of gripping, good bending/flexibility characteristics, and high durability. However, the domain of possible combinations of components which can be combined using straightforward manufacturing techniques is limited by component compatibility, which in turn depends upon the individual component compositions. Thus, while the incorporation of aesthetic features (e.g., three-dimensional effects) and even scenting agents in toothbrushes may be desired to improve product appeal to the user, the components required to obtain these properties often cannot be easily combined in an efficient and/or low-cost manner. For example, combining transparent and opaque plastics can require the use of chemical adhesives or bonding agents for acceptable adherence of these components.

BRIEF SUMMARY

Aspects of the invention relate to toothbrushes constructed of at least two components such as injection molded plastics having distinct optical properties (e.g., transparency). An toothbrush having a handle and a head. The handle may include a first component and a second component covering at least a portion of the first component. The first and second components may be chemically compatible. The first and second components may both comprise a hard polyolefin. The first and second components may have different transparencies. In one aspect, the first component may be opaque and the second component may be transparent or semi-transparent. In some aspects, the handle may also include a third component comprising a thermoplastic elastomer. Furthermore, there may be at least one projection extending outwardly from an outer surface of the first component.

In one aspect, the invention may be a toothbrush comprising: a base component having a gripping region and an oral engaging region, the base component being formed from a hard plastic; a plurality of projections protruding from a surface of the base component in the gripping region, the plurality of projections comprising a first projection that terminates in a first distal surface and a second projection that terminates in a second distal surface; a second component formed from a hard plastic covering at least a portion of the surface of the base component; wherein the first distal surface of the first projection is flush with an outer surface of the second component; and wherein the first component is opaque and the second component is transparent or semi-transparent.

In another aspect, the invention may be a toothbrush comprising: a base component having a gripping region and an oral engaging region, at least one projection protruding from a surface of the base component in the gripping region; a second component covering at least a portion of the surface of the base component and at least a portion of the projection; and wherein the base component is formed of an opaque rigid material and the second component is formed of a transparent or semi-transparent rigid material.

In yet another aspect, the invention may be a toothbrush comprising: a base component having a gripping region and an oral engaging region, the base component formed from a hard plastic and being opaque; a second component covering a first portion of the base component in the gripping region, the second component being formed of a hard plastic and being transparent or semi-transparent; and a third component formed of a thermoplastic elastomer.

These and other aspects of the invention will become apparent from the following detailed description.

BRIEF DESCRIPTION OF THE DRAWINGS

A more complete understanding of the present invention and the advantages thereof may be acquired by referring to the following description in consideration of the features depicted in accompanying drawings, which should be understood to present an illustration of the invention and/or principles involved, and in which like reference numbers indicate like features, and wherein.

DETAILED DESCRIPTION

Figure 1:
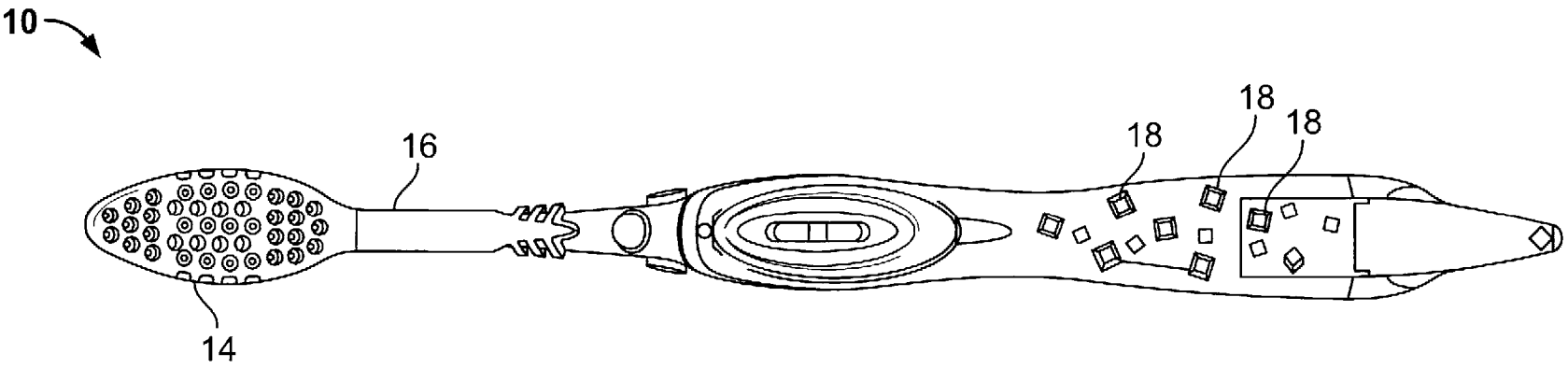
FIG. 1 is a front view of a base component of a toothbrush according to one or more aspects of an illustrative embodiment.

Aspects of the invention relate to multi-component toothbrushes having a number of distinct commercial advantages resulting not only from the types of materials used in the components but also from structural features, light transmitting properties, and other properties of these components. The combination of properties of the individual components advantageously provides appealing sensory effects that may include both visual effects and/or scenting (olfactory) effects. According to some embodiments, features such as three-dimensional structures in a base component of the toothbrush can be displayed through a transparent or semi-transparent second component. Varying the depth at which the features of the base component are covered by the second component consequently varies the degree to which the features are visible to the user. Similarly, if the base component incorporates a scenting agent, then the rate of diffusion of this agent to the exterior of the toothbrush (and ultimately to the user) may also be controlled by variation of the depth of coverage by the second component.

In this manner, one or more sensory effects (e.g., visual or olfactory) or characteristics of the toothbrush can be readily controlled by selecting a number of appropriate parameters (e.g., degree of transparency of the components, depth of coverage of one component over another, scenting agent concentrations of the components, etc.). Aspects of the invention are therefore directed to toothbrushes having exterior portions (e.g., portions of the handle) with more than one degree of visibility of structural features and/or more than one rate of scent release. These characteristics result when toothbrush components have properties and are combined as described herein.

Toothbrushes according to the invention are formed from combining at least two components having different optical properties (e.g., transparency). Materials suitable for the components of the toothbrushes include polymeric materials such as those which can be injection molded. In a representative embodiment, two components that are contacted to form the toothbrush, or at least form part of the toothbrush where visual features such as projections of a base component are displayed through a transparent or semi-transparent second component, both comprise a polyolefin (e.g., polyethylene such as high density polyethylene, polypropylene, a polyolefin blend such as an ethylene-propylene blend, or an olefin copolymer such as a random ethylene-propylene copolymer).

The use of two components comprising or even consisting essentially of polyolefins provides important advantages in terms of the chemical compatibility of the components. Components that are "chemically compatible," such as those that are both members of the olefin family, can adhere without the aid of a separate adhesive layer or bonding agent. Chemically compatible components may also be joined in a satisfactory manner without relatively complex mechanical interlocking that is sometimes employed between toothbrush components that are not chemically compatible (e.g., comprise dissimilar materials, as in the case of one component comprising predominantly a polyolefin and a second component comprising predominantly a non-polyolefin such as polystyrene, polycarbonate, or styrene-acrylonitrile).

Therefore, according to some embodiments, components of multi-component toothbrushes of the invention lack an adhesive, a bonding agent, or the use of mechanical interlocking between components. According to other embodiments, adhesive, bonding agent, and/or mechanical interlocking may be used even with the chemically compatible components, to achieve a relatively stronger and more durable bond between the components than would be achieved using components that are not chemically compatible. In still other embodiments, a relatively lower amount of adhesive or bonding agent, and/or a relatively lower degree of mechanical interlocking, may be used to achieve a bond between the chemically compatible components that is comparable in strength and integrity to that between two components that are not chemically compatible.

In view of the above description, it is apparent that joining chemically compatible components (e.g., both comprising predominantly polyolefins), according to aspects of the invention, simplifies the manufacture of toothbrushes to reduce costs and provide other distinct advantages. Such advantages include greater ease of processing (e.g., elimination or reduction of a pre-molding drying step). In the case of two components that both comprise polyolefins, advantages include retention of physical strength in the normal oral care use environment (due to chemical inertness of these components) and reduced material cost.

Figure 2:
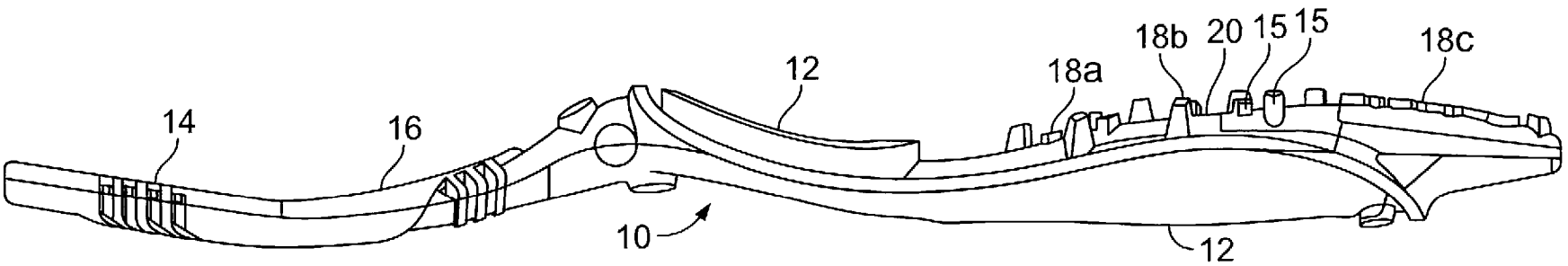
FIG. 2 is a side view of a base component of FIG. 1.
Figure 3:
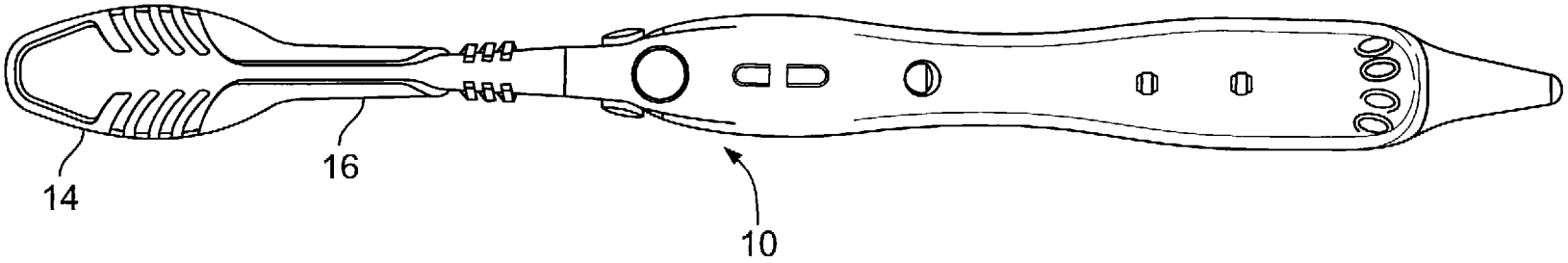
FIG. 3 is a rear view of a base component of FIG. 1.

FIGS. 1-3 depict various views of one component, referred to herein as a first or a base component 10, used in a representative toothbrush of the invention. Base component 10, as depicted, can provide the main structure of the toothbrush and consequently the main source of some of the overall toothbrush properties such as strength, flexibility/rigidity, etc. Base component 10 may be formed from a polyolefin such as polypropylene, as discussed above, into its desired shape by injection molding.

Base component 10, may comprise one or more gripping regions (references 12 in FIG. 2) or regions that are normally gripped or held by the user. Base component 10 may also comprise an oral engaging region 14 or region that is normally fabricated with cleaning elements such as bristle tufts that are applied to the user's teeth. A neck 16 may separate and extend between these regions and, according to FIG. 2, may provide a two-segmented structure with a front segment comprising gripping regions 12 and a rear segment comprising oral engaging region 14, with the front segment being inclined or angled relative to (i.e., not collinear with) the rear segment. For example, the front segment may be inclined (i.e., offset from the formation of a straight line) at an angle from about 5° to about 40° relative to the rear segment.

As may be best seen in FIG. 2, base component 10 includes projections 15 that form a three-dimensional decorative design. Projections 15 are shown in FIG. 2 protruding from an underlying surface 20, in gripping region 12 of base component 10. It will be appreciated that projections could be formed in other locations of base component 10, and that "projections" may refer to any of a number of features extending or protruding from base component 10, such as the simple columns shown in FIGS. 1 and 2, the lettering best shown in FIG. 1, or features having other horizontal cross-sectional shapes such as circles, ovals, stars, hearts, cartoon characters, etc., which may be projected through a second component of a transparent or semi-transparent material to provide a visually appealing effect. Furthermore, it is to be understood that the three-dimensional decorative design in the base component 10 may be created by cutouts in the underlying surface 20, rather than by protrusions from the underlying surface 20, so long as the projections 15 are formed.

According to some embodiments, projections 15 may provide visual effects that improve brand recognition and/or help associate the toothbrush with related products (e.g., toothpaste) bearing similar visual features and possibly being packaged together. For example, white square or rectangular projection surfaces 18 in a gripping region of base component 10, as shown in FIG. 1, may have an appearance that is similar to solid pieces of soluble breath-freshening agent that are visibly suspended in a packaged toothpaste.

As shown in FIG. 2, projections 15 may extend or protrude from underlying surface 20 of base component 10 at more than one height and/or be visible to different degrees through a second component overlying or covering these projections at varying thicknesses. As discussed in greater detail below, at least one, and possibly several or more, of a plurality of projections 15 extending from base component 10 may protrude entirely through a second component.

Projections 15 that protrude at different heights therefore may provide projection surfaces 18*a*, 18*b*, 18*c* at various levels above underlying surface 20, directly beneath projections 15 of base component 10. For example, projection surfaces 18*a*, 18*b*, 18*c* may be at a first, a second, and a third height above underlying surface 20, where two or all three of these heights are different. A second component could therefore easily be applied over projections 15 and all adjacent, surrounding underlying surfaces 20, for example in a gripping region 12 of base component 10, to cover base component 10 at varying thicknesses in this region.

In this manner, underlying surface 20 may be covered with a substantially uniform first thickness of a second component, while projection surfaces 18*a*, 18*b*, 18*c* may be covered with second, third, and/or fourth thickness of the second component. The second, third, and fourth thicknesses can differ from the first thickness and possibly also differ with respect to each other. Thus, the second, third, and fourth thicknesses may be substantially the same or all substantially different, or only some thicknesses may be substantially the same with respect to others, depending on the desired visual effect. If the overlying second component is partially transparent, then its use to cover projection surfaces of the base component at substantially the same thickness will result in substantially the same degree of visibility of these projection surfaces through the second component.

In a representative embodiment depicted in FIG. 2, first and second projection surfaces 18*a*, 18*b* (e.g., at different heights above underlying surface 20) are covered with a second, semi-transparent component at second and third thicknesses that are different, while adjacent, underlying surface 20 is covered at a first thickness that is different from both of the second and third thicknesses. Thus, for example, projection surface 18*b*, which is at a greater height above underlying surface 20 than projection surface 18*a*, may be covered by a relatively smaller thickness of a semi-transparent second component, to provide a more clearly visible projection surface 18*b* and a more faintly visible (or more obscured) projection surface 18*a*. Projection surfaces may have any shape, as discussed above with regard to the cross-sectional shapes of projections. Projection surfaces typically have areas that project appealing features including squares or rectangles of about 1-10 $mm^2$ in area. Projection surfaces may have larger or even smaller areas, such as in the case of one or more projections that taper essentially to points, creating a visual image in the form of a small dot or dots.

As mentioned above, according to some embodiments, the thickness of a second component covering a projection surface may be zero, such that a projection surface (or a portion of a plurality of projection surfaces) may protrude entirely through the second component. Such an embodiment is depicted for a representative toothbrush in FIG. 4 and a simplified cross-section of this toothbrush in a gripping region is depicted in FIG. 5. As shown in these figures, projection surfaces 18*b* protrude through second component 40 that covers a portion of a gripping region. These projection surfaces 18*b*, covered with second component 40 at a third thickness that is zero, are therefore completely visible. Other projection surfaces 18*a*, however, are covered with second component 40 at a second thickness that may be, for example, about 2 mm, while the adjacent underlying surface is covered at a first thickness, for example, about 4 mm, that is different from both the second and the third thicknesses.

As shown in FIG. 5, projection surfaces 18*b* protruding through second component 40 are essentially flush with the surface of second component 40, such that projections 15 and second component 40 cooperate to form a smooth or essentially smooth exterior in areas where the second component is present, such as in the handle or other portions of the gripping area. According to other embodiments, exposed projection surfaces 18*b* may extend above the surface of the second component 40 or be recessed below this surface.

Figure 4:
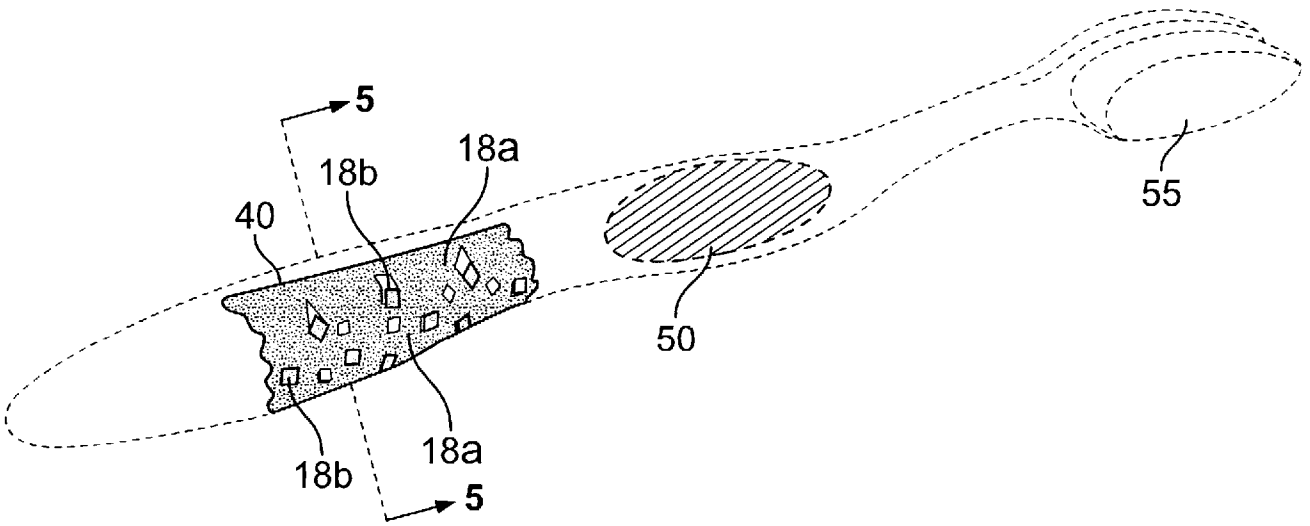
FIG. 4 is a front view of a toothbrush according to one or more aspects of an illustrative embodiment.
Figure 5:
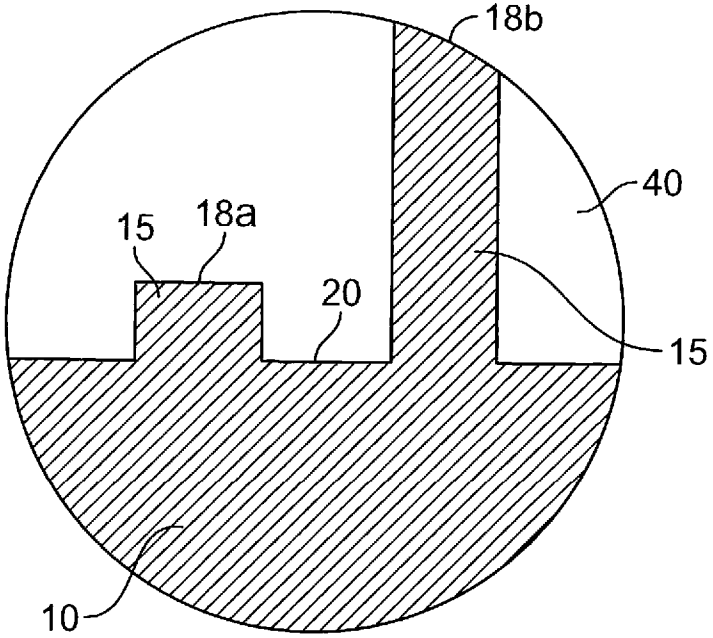
FIG. 5 is a simplified cross-sectional view, taken across section 5-5, of the handle of the toothbrush of FIG. 4.

In the embodiment of FIGS. 4 and 5, therefore, underlying surface 20 (covered at a first thickness) of base component 10 will be more obscured (or less visible) than some projections surfaces 18*a* (covered at a second thickness), which are in turn more obscured than other projection surfaces 18*b* (covered at a third thickness, which is zero in the case of FIGS. 4 and 5). By adjusting the transparency of overlying second component 40, it may be possible to almost completely or completely obscure underlying surface 20 (rendering it substantially invisible) and also provide a distinct difference between the relative visibilities of projection surfaces 18*a*, 18*b* covered at different thicknesses. This may have a desired effect, for example, of simulating objects that are "submerged" to various degrees in a semi-transparent second component. Additional projection surfaces, for example, in the form of lettering (see FIG. 1) may be covered with the second component at a thickness that substantially matches any of the first, second, or third thickness, or otherwise covered at another, different thickness.

The second component, according to aspects of the invention, covers the base component at more than one thickness to provide sensory effects such as the visual effects discussed above. Usually, the base component of the toothbrush is covered only in one or more areas (such as at least a portion of the handle or gripping region but often not the entire handle) where the sensory effects are desired. In other regions that are not covered, therefore, the thickness of the second component can be considered to be zero. According to the description above, then, the second component can be said to cover the base component (which includes its projection surface(s) and its underlying surface) at more than two different thicknesses, or more than one non-zero thicknesses having discreet values (e.g., about 2 mm and about 4 mm) to provide the visual effects described herein. According to some embodiments, the second component will cover the base component, for example in a portion of the gripping region, at a maximum thickness of about 8 mm, and typically about 5 mm.

In desired areas, such as a portion of the handle or gripping region, where the second component is used to cover the base component, the second component may be injection overmolded. As discussed above, the second component is used to cover projection surfaces formed from projections in the base component, as well as adjacent underlying surfaces. These projection surfaces may be formed on any part, including recessed areas, of the base component, onto which the second component is desirably overmolded. It will be appreciated that the base component, used to form projections, may be, but is not necessarily, the innermost component of the toothbrush. For example, the base component may be disposed upon an inner core component, such that the base component is actually between the core component and the second component. The main consideration is that the visual effects discussed above can be achieved, and various combinations of components for this purpose will be become apparent to one of skill in the art, having regard for the present disclosure.

As discussed above, the second component is advantageously chemically compatible with the base component, to provide favorable adherence/bonding between these components. Thus, if the base component comprises a polyolefin, then the second component may be, for example, polypropylene or a random ethylene-propylene copolymer.

To provide the visual effects described above, in which features of the base component are visible to varying degrees through the second component, the base component and second component may have different transparencies. For example, the base component may be essentially opaque (e.g., have an opaque white color or other opaque color) while the second component may be at least semi-transparent (e.g., have a semi-transparent blue color). Semi-transparency or full clarity can be achieved, for example, by modification of the second component with a clarifying agent, with the degree of transparency depending on the concentration of clarifying agent.

The extent of clarification or transparency of the second component will govern the degree to which projections (e.g., columns, a product logo, or other features) in the base component are visible through various thicknesses of the second component. In a representative embodiment, good visual effects are obtained when the second component has a maximum haze value of about 20% (e.g., from about 5% to about 20%) at a thickness of 2 mm and a maximum haze value of about 45% (e.g., from about 25% to about 45%) at a thickness of about 3 mm. The haze value may be measured according to ASTM D-1003 for transparent parts. The clarified second component may be used with its natural color or may be tinted with coloring agents known in the art, including soluble colorants such as Milliken Clear Tint® (Milliken Chemical, Spartanburg, S.C.).

Advantageously, other sensory effects of the overall toothbrush may be incorporated and controlled in a manner similar to that discussed above with respect to the visibility of projections of the base component (e.g., by varying the thickness of the overlying second component and/or the transparency of the second component relative to the base component). In the case of a smell (scenting or olfactory) effect, for example, the scenting of polymeric materials and particularly polyolefins may be accomplished by blending a scenting agent, optionally together with a carrier, directly into these materials prior to injection molding.

Scenting agents for polymeric materials include aromatic oils and other liquids that are slowly released, as described, for example, in U.S. Pat. No. 6,334,974. Carrier materials that are blended with scenting agents include polymers such as polyolefins (e.g., polyethylene) and ethylene vinyl acetate copolymer. Scenting compositions, comprising both a scenting agent and a carrier, may be used in preparing scented plastics having a wide range of possible scents or fragrances, including vanilla and mint. Examples of such compositions include those available under the PolyIFF® brand from International Flavors and Fragrances, Inc (New York, N.Y.). Combinations of scenting agents can also be used.

Those skilled in the art can readily determine the types of scenting agent carrier that are compatible with component materials used in the toothbrush. Generally, the scenting agent, if used, is incorporated as a scenting composition with a carrier into a component such as the base component in an amount such that the characteristics of the base component are not substantially altered. Thus, a base component comprising predominantly a polyolefin such as opaque white polyethylene may be impregnated with a scenting agent in an amount such that the desired properties and characteristics of the base component (e.g., color, adhesion/bonding to other polyolefin-containing components, ability to be processed, strength, etc.) are substantially retained.

Typical weight ratios of scenting composition (i.e., combined scenting agent and carrier) to base component or other component (e.g., the second component) range from about 1:20 to about 1:5, and often from about 1:19 to about 1:9. The amount of scenting agent added will depend on the desired strength of the scent released from the toothbrush and the duration of this scent release. Those skilled in the art can readily determine the relative quantity of scenting agent required for a desired release rate of scenting agent (e.g., that will generally be perceived as pleasant to most users) over an extended period (e.g., a projected shelf life of the toothbrush).

The use of multiple thicknesses of the second component to cover a base component comprising a scenting agent will result in multiple rates of release of the scenting agent at different areas of the toothbrush exterior. For example, according to the embodiment of FIG. 5, some projection surfaces 18*b* of base component 10 may protrude through second component 40 that covers a portion of a gripping region, while other projection surfaces 18*a* are covered by second component 40. In the case where base component 10 comprises a scenting agent and second component 40 does not, the release rate of scenting agent from projection surface 18*b* will be higher per unit area than the release rate of scenting agent from projection surface 18*a*.

Analogous to the manner in which visibility is varied and controlled, as discussed previously, the rate of scent release can also be varied and controlled. Thus, projection surfaces 18*b*, covered with second component 40 at a third thickness that is zero, are completely visible and release a maximum rate of scenting agent per unit area of the projection surface 18*b*. Other projection surfaces 18*a* that are covered with second component 40 at a second thickness release a relatively lower rate of scenting agent per unit area, due to diffusion limitations through the second component. Adjacent underlying surfaces may be covered at a (still higher) first thickness, such that the release of scenting agent per unit area of these surfaces is minimized.

By varying the thickness with which the second component covers the base component, it is therefore possible to provide varying rates, per unit area, of release of a scenting agent from the base component. Just as projections may be formed with two, three, four, or more discreet degrees of visibility (e.g., by having this number of discreet overlying second component layer thicknesses), these projections may likewise release scenting agent at two, three, four, or more discreet rates per unit area in order to provide a desired combination of sensory (visible and olfactory) effects.

Therefore, according to some embodiments, the rate of scenting agent release per unit area through projection surfaces may correspond (e.g., in a proportionate manner) to the degree of light transmission to (i.e., the visibility of) these surfaces. In other embodiments, these corresponding optical and olfactory effects may not be desired and can be independently regulated. For example, independent control of visibility or projection surfaces is possible by varying the relative transparencies of the base component and second component, while, analogously, independent control of the scenting agent release rate from the projection surfaces is possible by varying the scenting agent concentrations in these components. In view of the present disclosure, it will be appreciated that a number of other factors can be controlled to obtain a desired combination of visibility and scent release properties from projection surfaces, including the component thicknesses, as well as relative light transmission and scenting agent diffusion characteristics of the components.

According to representative embodiments, only one of the two components will possess at least some transparency and/or one of the two components will comprise scenting agent. As discussed above, often the base component is opaque and the second component at least partially transparent. Likewise, often the base component comprises (e.g., is impregnated with) a scenting agent and the second component has none, except for those amounts originating and diffusing from the base component into the second component after these components are adhered.

In addition to the base component and second component, described above, toothbrushes according to the present invention can have other components. For example, a third, elastomeric component can be used in the gripping region, as illustrated by feature 50 of FIG. 4. Third component 50 may be overmolded onto, or co-injection molded with, the base component or other components to provide improved gripability in the gripping region and/or provide other functional components.

In the representative embodiment of FIG. 4, third component 50, namely a thermoplastic elastomer, covers an additional portion of the base component in the gripping region, which is not covered by second component 40. Third component 50, for example, may be used to cover both finger gripping and thumb gripping areas in the gripping region on opposite sides of the toothbrush handle, thereby providing a non-slippery grip surface that improves user control especially in wet or slurry environments. The third component may also be used in the oral engaging region, for example on a side opposite bristle tufts 55 or other cleaning elements on the toothbrush head. In this location, the third component can provide additional functions including tongue cleaning, plaque removal, and/or gum massage.

Representative elastomers suitable for use a third component include thermoplastic elastomers such as those comprising polyolefins (e.g., olefin homopolymers and olefin copolymers), ethylene-propylene rubbers and elastomers (e.g., ethylene propylene diene monomer), styrene-butadiene-styrene, styrene-ethylene-butylene-styrene, polyesters, or polyurethanes. The durometer or hardness values of these elastomeric materials will generally range from about 10 to about 70 Shore A.

Additional components, including other elastomers with 0 to 70 Shore A durometer values, can also be included in toothbrushes described herein. Such additional elastomers will generally have physical and mechanical properties that are different from the third component. Additional elastomers, for example, may be overmolded onto the base component and/or second component in a manufacturing step that is separate from the application of the third component. Additional elastomers may provide aesthetic features and functions that differ from those of the third component.

Toothbrushes described herein thus can provide a number of sensory effects, including visual effects, scenting effects, or combinations of these effects. These effects can result from surfaces such as projection surfaces having multiple degrees of visibility and/or multiple rates of scent release.

Inventive aspects described herein may be incorporated into a manual toothbrush or a powered toothbrush. While the invention has been described with respect to specific examples including presently preferred modes of carrying out the invention, those skilled in the art will appreciate that numerous variations and permutations are possible. It is to be understood that other embodiments may be utilized and structural and functional modifications may be made without departing from the scope of the present invention. Thus, the spirit and scope of the invention should be construed broadly as set forth in the appended claims.

What is claimed is:

1. A toothbrush comprising:

an opaque base component comprising an outer surface and at least one projection protruding from the outer surface;

a second component covering the outer surface of the base component, the second component being at least semi-transparent; and wherein a distal end of the at least one projection is flush with an outer surface of the second component;

a third component formed of a thermoplastic elastomer covering at least one of: (1) a portion of the base component; and (2) a portion of the second component; and wherein the opaque base component and second component are chemically compatible, comprise a hard polyolefin, and the opaque base component and the second components have different transparencies.

2. The toothbrush according to claim 1 wherein the opaque base component is formed from a hard plastic.

3. The toothbrush according to claim 2 wherein the second component is formed from a hard plastic.

4. The toothbrush according to claim 1 further comprising a third component formed of a thermoplastic elastomer covering portions of the base component in a gripping region that are not covered by the second component.

5. The toothbrush according to claim 1 further comprising:

a plurality of bristle tufts extending from a first side of a head; and a third component formed of a thermoplastic elastomer covering a portion of a second side of the head that is opposite the first side of the head to form a tongue cleaner.

6. The toothbrush according to claim 1 further comprising a third component formed of a thermoplastic elastomer covering at least a portion of the second component.

7. The toothbrush according to claim 1 wherein the second component is overmolded onto the base component.

8. The toothbrush according to claim 1 wherein the second component is transparent.

* * * * *